United States Patent [19]

Walker et al.

[11] Patent Number: 5,016,461

[45] Date of Patent: May 21, 1991

[54] METHOD AND APPARATUS FOR STAMPING WELD ADAPTERS

[75] Inventors: William R. Walker, Rochester; George W. Lukowski, Bloomfield Hills, both of Mich.

[73] Assignee: Hydro-Craft, Inc., Rochester Hills, Mich.

[21] Appl. No.: 402,067

[22] Filed: Sep. 1, 1989

[51] Int. Cl.[5] ..... B21D 28/06

[52] U.S. Cl. ..... 72/336; 72/333; 72/339; 10/86 F

[58] Field of Search ..... 72/333, 337–339, 72/336, 356, 335; 29/150; 10/86 F; 411/108, 107, 84, 85, 171

[56] References Cited

U.S. PATENT DOCUMENTS

| | | | |
|---|---|---|---|
| 1,325,194 | 12/1919 | Geist | 72/335 |
| 2,096,623 | 10/1937 | Almdale | 411/171 |
| 2,105,139 | 1/1939 | Demboski | 411/171 |
| 2,221,598 | 11/1940 | McLaughlin | 10/86 F |
| 3,010,126 | 11/1961 | Willcox | 10/86 F |
| 3,251,079 | 5/1966 | Anderson | 411/171 |
| 3,397,431 | 8/1968 | Walker . | |
| 3,414,220 | 12/1968 | Walker . | |

FOREIGN PATENT DOCUMENTS

| | | | |
|---|---|---|---|
| 126338 | 9/1980 | Japan | 72/461 |
| 137529 | 7/1985 | Japan | 72/335 |
| 603198 | 6/1948 | United Kingdom | 411/171 |

OTHER PUBLICATIONS

Hydro-Craft, Inc. Hydraulic Products & Accessories Catalog No. 807, (front & back cover and pp. 11–14), Aug. 1981.

*Primary Examiner*—Daniel C. Crane

*Attorney, Agent, or Firm*—Harness, Dickey & Pierce

[57] ABSTRACT

A progressive die apparatus and method for cold forming weld adapters. A progressive die apparatus, preferably having at least four working stations and several idle stations, is used to form, weld adapters from rectangular bar stock having a thickness of at least about ⅜ inch. Plain-carbon steel bar stock material or other weldable metal material is successively fed through the progressive die apparatus, which is preferably installed in a knuckle-joint power press. The cold forming method includes the following steps: (a) at a first working station piercing the first hole; (b) at a second working station coining the stock material in the area surrounding the first hole to define a collar-like configuration including a hollow region for receiving the fastener; (c) at a third working station repiercing said stock material to remove material that was displaced in the first hole during the coining step; (d) successively advancing stock material from the first to the last working stations; and (e) at a fourth working station cutting the stock material after steps (a) through (c).

10 Claims, 6 Drawing Sheets

METHOD AND APPARATUS FOR STAMPING WELD ADAPTERS

TECHNICAL FIELD

This invention relates to the manufacture of mounting devices for clamp assemblies, and more particularly to the manufacture of cold-formed weld adapters, used to secure clamping assemblies to a surface, by progressive die stamping techniques.

BACKGROUND

Clamping devices for retaining pipes, tubing and hose carrying hydraulic oil, air, coolant or other fluids in fixed position are popularly employed in numerous industrial applications. For instance, one such common clamping application involves the clamping of assemblies supporting two or more tube fittings or hose connections, such as those encountered in heat exchanger systems, hydraulic systems, and the like. One such clamping assembly is the MULTI-CLAMP TM clamping system, manufactured by Hydro-Craft, Inc., of Rochester Hills, Mich. Generally speaking, this system includes a clamping assembly adapted to hold a plurality of fittings for hose or hydraulic connections which may be of the same or of different sizes. Various features of the MULTI-CLAMP TM system are disclosed in U.S. Pat. Nos. 3,397,431 and 3,414,220 of William R. Walker.

A clamp device such as the MULTI-CLAMP TM assembly can be secured to a surface by welding a weld adapter to the surface and fastening the U-shaped channels of the clamping device to a bolt associated with and rigidly held in place in the weld adapter. A weld adapter, as used herein, is a generally rectangular block of metal adapted for receiving and holding in a stationary position a conventional fastener, such as a bolt, by its head end. The weld adapter is of sufficient mass so that it can be readily tack welded with a conventional arc or gas welder to a mounting surface so that the fastener projects away from such surface. The mounting surface could be any rigid metal member, from the frame of a machine or vehicle to a structural steel beam in a factory. A clamp can then be fastened to the fastener of the weld adapter, which protrudes from a face of the rectangular section. Weld nut adapters must be fairly thick in order to be sufficiently strong and rugged to stand up to heavy welding and the kinds of loads which may be placed on the fasteners held therein.

Until the present invention, the most efficient way known to make weld adapters has been to fabricate them by hot forging methods. Unfortunately, hot forging methods tend to be economically undesirable for making weld adapters. In particular, hot forging methods typically require an induction furnace (requiring increased energy consumption), special handling equipment, and special equipment to control pollution that is attendant with hot forging methods. Accordingly, the production of smaller quantities of (i.e., less than 100,000) of hot forged weld adapters in a single run is generally economically impractical.

Accordingly, it is an object of the present invention to provide a method of making weld adapters that does not incorporate hot-forming methods.

It is a further object of the present invention to provide a method of cold stamping weld adapters from relatively thick metal stock using progressive stamping techniques to produce reliably and economically small lots of weld adapters suitable for being tack welded to a support surface.

It is a further object of the present invention to provide a novel progressive die set for use in a knuckle joint press for stamping weld adapters.

SUMMARY OF THE INVENTION

In light of the foregoing problems and to fulfill the above-stated objects, there is provided, according to one aspect of the present invention, a progressive die apparatus for repetitively making substantially identical weld adapters in a coining press having a reciprocating ram and stationary bolster. The weld adapters each have a collar-like configuration and a generally centrally located hole for stationarily holding a fastener having a shank portion and a head end by its head end, such that the shank portion projects through the hole. The die apparatus has at least four working stations where, during successive strokes of the press, metal is formed and removed from an elongated strip of metal stock having a substantially rectangular transverse cross-section and a thickness of at least about ⅜ inch. The die apparatus comprises: (a) means for restraining the elongated strip of metal stock in two directions substantially normal to the longitudinal direction of movement of the metal stock as the metal stock is advanced downstream; (b) first punch means, located at the first working station, for repetitively forming first holes in successive segments of the metal stock advanced through the first working station; (c) pilot means, downstream from first working station, for helping stabilize the metal stock when metal-forming pressure from the press is applied to said stock; (d) coining means, located at a second working station downstream from the pilot means, for repetitively cold-forming said metal stock in regions surrounding successive ones of the first holes to make in each segment of the stock passing therethrough a collar-like configuration having a hollow region for receiving a head end of a fastener; (e) second punch means, located at a third working station downstream from the second working station, for repetitively reforming the first holes in successive segments of the metal stock advanced through the third working station; (f) means, located at a fourth working station, for successively shearing segments of the metal stock including reformed first holes from upstream elongated portion of the metal stock; and (g) means, near the fourth working station, for controlling longitudinal advance of the metal stock between strokes of the press. The coining means (d) for cold-forming preferably includes a plunger tool having an end portion provided with a hexagonal cross-section. The end portion of this plunger tool preferably has an end face provided with a centrally located concave cavity of sufficient volume to permit flow therein of some of the metal stock during coining. This concave cavity was found to be beneficial for materially reducing the force required to accomplish the coining operation. The means (g) for controlling longitudinal advance preferably includes a floating gage stop.

According to a second aspect of the present invention there is provided a method of cold-forming a weld adapter, comprising the steps of: (a) piercing a hole, having a diameter in the range of about 0.25 inch to about 0.75 inch in a plain-carbon steel bar stock material having a thickness of about ⅜ inch to about ¾ inch; (b) coining the stock material in an area surrounding the hold to define a collar-like configuration for receiving a bolt having a hexagonal head; (c) re-piercing the stock material to remove stock material that was displaced into the area surrounding the hole during the coining step (b); (d) successively advancing the stock material from a location form the hole-forming step (a) to a location for the cold-forming step (b), and to a location for the re-piercing step (c); and (e) cutting the stock material after the steps (a), (b) and (c) to define a weld adapter for welding to a surface so that a stem of the bolt projects away from the surface.

Among the advantages of the present invention is that cold forming methods can be employed to economically produce relatively high quality weld adapters in low volume production runs of 5,000 to 25,000 pieces, without the need for using undesirable hot forging methods.

These and other advantages, features and objects of the present invention will become more readily understood by studying the following detailed description of the preferred embodiments in conjunction with the attached figures and subjoined claims.

BRIEF DESCRIPTION OF THE DRAWINGS

In the drawings like reference numerals are used to indicate identical features in the various figures, wherein.

DETAILED DESCRIPTION OF THE PREFERRED EMBODIMENT

Figure 2:
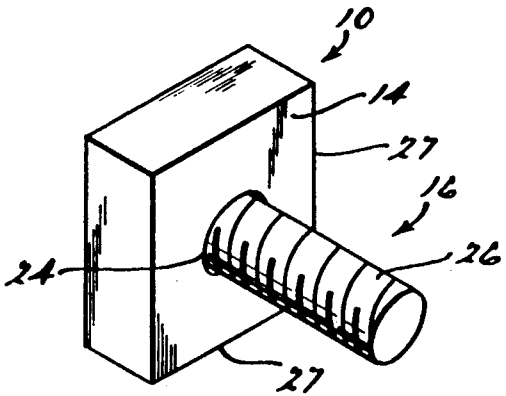
FIG. 2 is a front perspective view of the weld adapter of FIG. 1 having a bolt therein.
Figure 1:
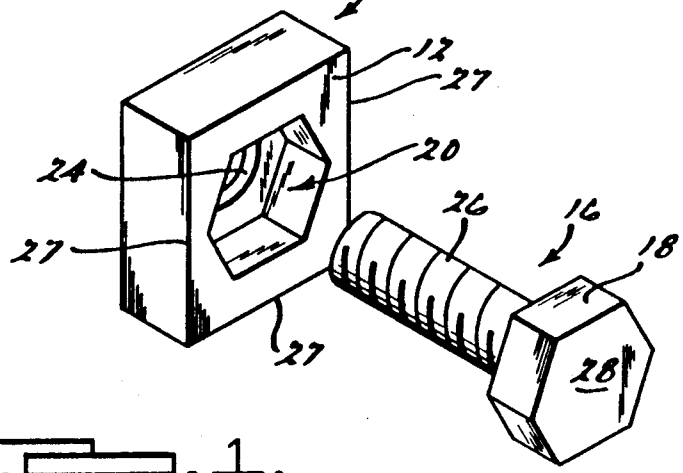
FIG. 1 is a rear perspective view of a weld adapter made with the apparatus and method of the present invention having seated therein a bolt.

Referring to FIGS. 1 and 2, a weld adapter 10 made by the die apparatus and method of the present invention is shown. Adapter 10 has opposed generally parallel first and second faces 12 and 14 as shown. Preferably the weld adapter 10 is adapted for receiving a fastener, such as a bolt 16 having a hexagonal head 18. However, other fasteners for which weld adapters can be adapted to receive include, without limitation, screws, lugs, dowels, hooks, nails and the like.

The weld adapter 10 of the present invention is a generally rectangular member made of a weldable material, such as a metal. The weld adapter 10 is a collar-like device in which the first face 12 has a hexagonal (or other suitably shaped) depression extending from the surface of face 12 to a base surface 22 within the weld adapter 10. The weld adapter further has a hole 24 that extends from the base surface 22 through to the second face 14. The inner walls of the flange and the base surface 22 thus define a seat 20 for a head of a fastener. In this regard, the depth of the seat 20 is predetermined and is sufficient receive and to house the entire head portion 18 of the fastener 16.

In the presently preferred embodiment, the inner walls of the depression 20 are preferably disposed relative to each other to define a hexagonal seat. Preferably the hole 24 is generally circular and has a diameter suitable for receiving, and may be slightly larger than, the threaded shank portion 26 of the bolt 16. The bolt 16 can be inserted in the weld adapter so that the face 28 of the fastener head is substantially flush with the first face 12 of the weld adapter 10. The metal along the edges 27 of the perimeter of the first face 12 of the weld adapter 10 can then be welded, using suitable methods, so that the face 12 is flush to a substantially flat support surface (not shown) so that the stem or shank portion 26 of the fastener 16 projects away from the surface.

Such weld adapters, once so welded with fasteners captivated therein, can then be used in connection with assemblies, such as clamp assemblies disclosed in aforementioned U.S. Pat. Nos. 3,397,431 and 3,414,220, the disclosures of which are hereby incorporated by reference.

The weld adapters 10 of the present invention are preferably made from a suitable material, such as a metal. In this regard, the material, referred to herein as "stock material", is preferably a material capable of being cold formed and welded to a surface. Accordingly, suitable stock materials for the manufacture of weld adapters include, without limitation, iron base alloys, such as steel and stainless steel. Alternatively it is possible to manufacture weld adapters from other alloy systems including, without limitation, aluminum alloys, copper alloys, and the like.

In the present preferred embodiment, the stock material is a steel. Preferably, the steel is supplied as a cold-rolled and annealed steel, a hot-rolled steel, or a combination thereof. More preferably, the stock material is a low alloy steel having a relatively low carbon content. Still more preferably, the stock material is a plain-carbon steel having a carbon content in the range of about 0.03% carbon to about 0.30% carbon, and still more preferably, the metal is a plain carbon steel having a carbon content of about 0.08% carbon to about 0.20% carbon, such as a hot-rolled ASTM 1018 steel. All percentages herein are by weight of the total composition.

When stainless steel is employed, preferred stainless steel materials include austenitic stainless steels, such as type 304 or 316 stainless steels. Alternatively, it is also contemplated that ferritic or martensitic stainless steels can be employed for the weld adapters of the present invention.

Figure 3:
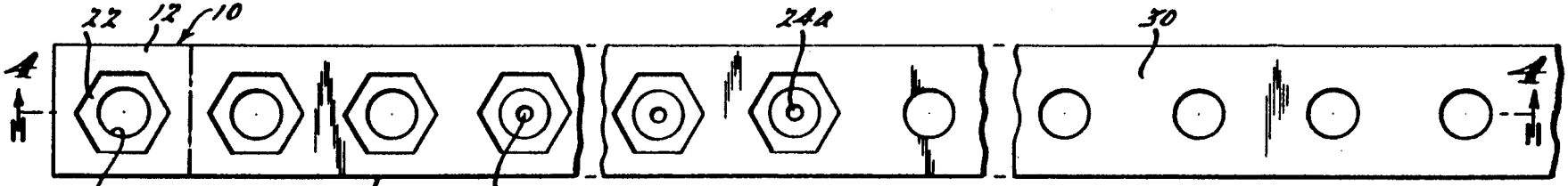
FIG. 3 is a plan view of a length of metal bar stock being cold-formed using the progressive die stamping methods of the present invention, which shows the various steps involved in forming a completed weld adapter.
Figure 4:
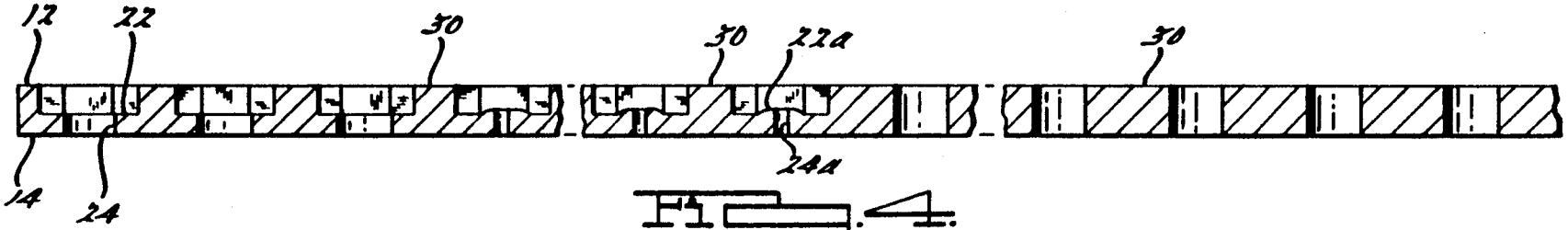
FIG. 4 is a cross-sectional side view of the metal bar of FIG. 3 taken along line 4—4 of FIG. 3.

The stock material for making weld adapters of the present invention may be supplied in any suitable form including, without limitation, strip, bar, rod, coil, sheet, plate and the like. The preferred form of stock material is supplied as a bar stock 30 which, as shown in FIGS. 3 and 4 is rectangular in transverse cross-section, and generally permits the ready formation of a weld adapter of rectangular configuration.

In general, the methods of the present invention for making a weld adapter of the present invention, use progressive stamping dies employing at least two working stations, and include the steps of: (a) at a first working station, forming a hole in a stock material; and (b) at a second working station, cold-forming the stock material in an area surrounding the hole.

More preferably, the methods of the present invention use four working stations and include the steps of: (a) at the first working station, forming a circular hole in successive segments of an elongated bar of stock material; (b) at the second working station, coining the stock material in an area surrounding the hole to form a collar-like configuration for captivating the head end of a fastener; (c) at the third working station, removing stock material that was displaced into the hole region during coining to restore or enlarge the hole to its desired size; and (d) at the fourth working station, cutting off the stock material.

While it is preferable that the methods of the present invention are carried out using a progressive die forming methods which further employ a continuous feed apparatus for successively introducing stock material to the die, it will be appreciated that a variety of alternative metal-forming methods and apparatuses may be employed to form a weld adapter of the present invention.

Figure 5:
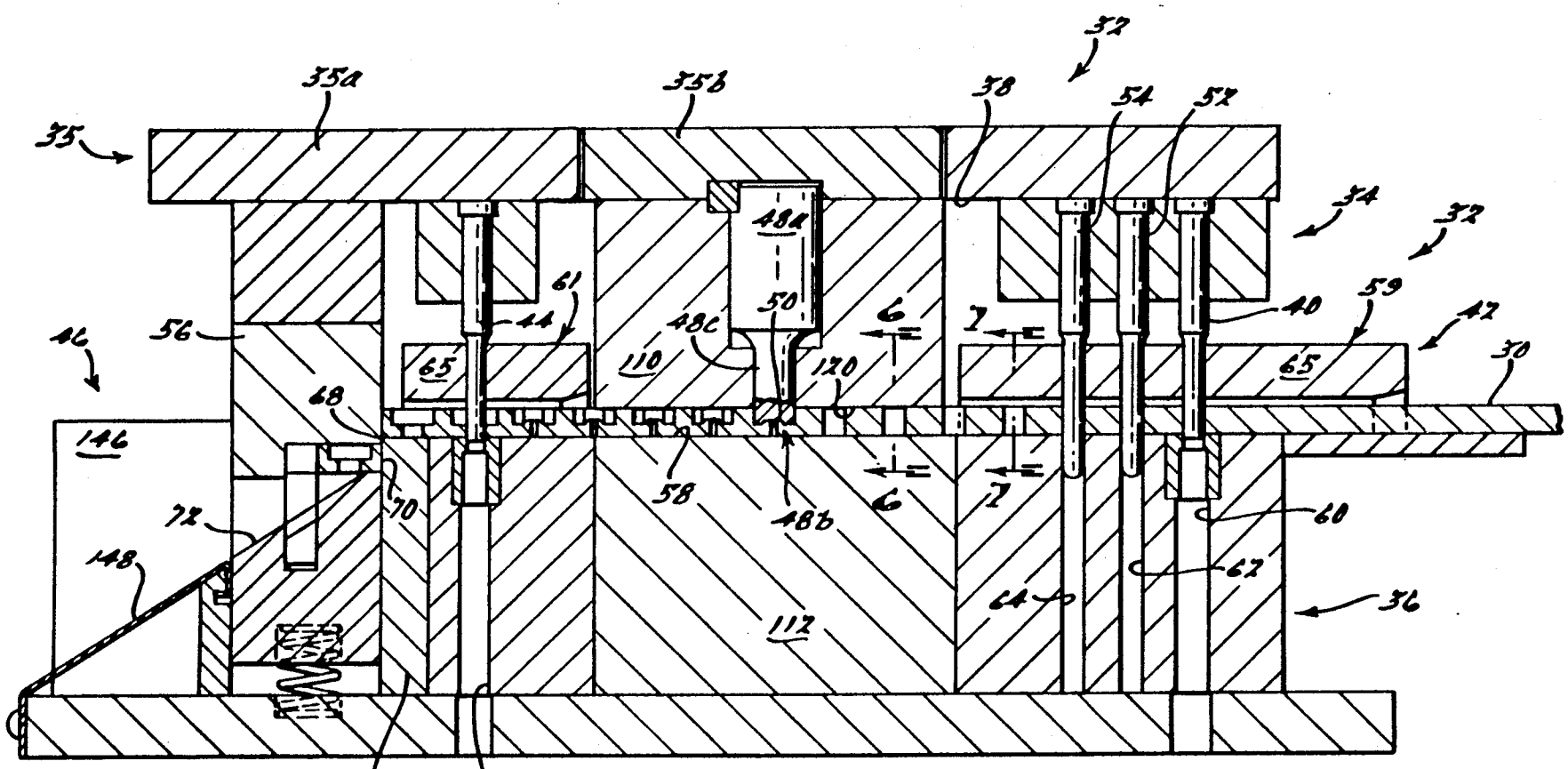
FIG. 5 is a longitudinal cross-sectional view of a die assembly of the present invention shown in its fully closed position.
Figure 6:
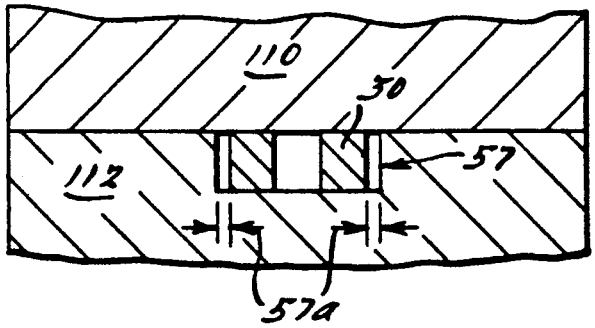
FIG. 6 is a fragmentary cross-sectional view taken along line 6—6 of FIG. 5 showing the guide groove for the bar stock in the central portion of the lower die set.

Referring to FIGS. 5 and 6, the methods of the present invention preferably incorporate the use of a progressive die assembly 32, having a longitudinal axis, which is insertable in a suitable apparatus for applying pressure to form the stock material, such as a mechanical power press.

A preferred press for use with the present invention is a conventional electric-motor-driven, pneumatic air clutch/brake actuated, knuckle-joint press. Such a press is also known as a coining press and preferably is at least a 600 ton press, and more preferably it is an 800 ton press. Suitable knuckle joint presses are manufactured by the Minster Company of Minster, Ohio. It is believed that while other presses may be suitably employed, such as large hydraulic presses or OBI mechanical presses, the knuckle joint press offers a particular advantage in that coining is readily achieved due to desirable rates of deformation and energy distribution imparted by the press to the deforming metal.

Moreover, while a progressive die assembly is preferred, it is believed alternative dies may be substituted, with appropriate modification to the present methods and apparatus, to achieve desired results including, without limitation, using a set of single station dies.

As shown in FIG. 5, the progressive die assembly 32 generally includes an upper portion or die assembly 34 and a lower portion or die assembly 36. The upper and lower portions are aligned so that the lower portion 36 can receive the upper portion 34 in a mating-type relationship. The upper and lower portions 34 and 36 are respectively interconnected in conventional fashion to thick hardened tool steel plates 35 and 37, which in turn are conventionally interconnected to conventional die shoes of mild steel (not shown) that are bolted to the conventional ram and bolster (not shown) of the press.

Thus, the upper die set portion 34 of the die assembly 32 is conventionally mounted to the reciprocating ram of the press and preferably includes a plurality of metal forming members projecting downwardly from a downwardly facing surface 38 of the upper portion of the die assembly. The metal forming members may be substantially straight, or may be tapered very slightly. A plurality of pilot members for meshingly engaging the stock material, and generally stabilizing the stock material during metal forming operations, also projects downwardly from the downwardly facing surface 38.

The metal forming members preferably include: a first forming member or punch 40 at a first working station, near a upstream end 42 of the upper portion 34, for piercing a hole in the stock material; a second forming member 44 at a third working station for piercing a hole in the stock material, being located near a downstream end 46 of the upper portion; and a coining member **48*a* at a second working station disposed between the first and second forming members 40 and 44**.

Preferably the die assembly 32 is made principally from suitable tool steel manufactured using known methods, such as those described in Metals Handbook, Vol. 3 (1980), which is hereby expressly incorporated by reference. Suitable tool steels include, without limitation high speed tool steels, such as chromium tungsten molybdenum tool steels, or the like. For instance, tool steels may be selected from alloys of AISI series A, D, H, M, O, S, T, or W. Moreover, the metal forming and coining members are preferably heat-treated, hardened, and ground to a finish in conventional ways that are suitable for piercing, deforming and shearing metals according to the present methods.

Preferably formed on an unconnected end **48*b* of the coining member 48*a* is a plunger tool 48*c* having a configuration formed at the end of 48*b* thereof corresponding substantially with desired seat configuration of the weld adapter. For example, in an end portion 48*b* of the plunger 48*c* having a hexagonal cross-section for making a weld adapter for a bolt having a hexagonal head. The plunger end 48*b* is hollowed out in the center thereof in the form of a dimple 50 which is preferably a concave rounded recess. The dimple accordingly defines a cavity which should be of sufficient volume to permit flow therein of some of the metal displaced during coining into the hole earlier formed by punch 40. Preferably the cavity 50 has a depth of about one-sixteenth of an inch, and a diameter of about one eighth of an inch to about one sixteenth of an inch less than the diameter of the punch 40**.

The pilot members preferably include a first pilot member 52 and a second pilot member 54 respectively located at first and second idle stations immediately after the first working station. In the present preferred embodiment, the pilot members have a cross-sectional diameter slightly less than the diameter of the holes formed by the first forming member. Further, the pilot members are preferably slightly longer than the metal forming members. Accordingly during metal forming, upon downward movement of the upper portion 34 of the die assembly 32, the pilot members 52 and 54 meshingly engage and substantially stabilize the stock material, by penetrating holes formed by the first piercing member 40, before the forming and coining members contact the stock material. The punches 40 and 44 at the first and third working stations preferably contact the stock material and are substantially if not entirely through with the significant energy-consuming portion of their travel prior to plunger 48 at the second working station beginning the significant energy-consuming portion of its cycle.

The upper die set 34 also has a cutoff member 56, which preferably has a block-like configuration, disposed near the downstream end 46 of the upper portion 34 of the assembly 32 die. As will be explained further, the cutoff member 56 cuts the stock material, subsequent to the forming operations, to thereby shear individual weld adapters from the bar of stock material.

Figure 7:
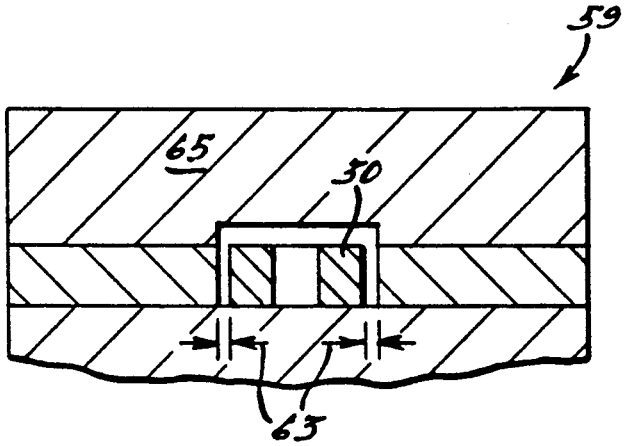
FIG. 7 is a fragmentary cross-sectional view taken along line 7—7 of FIG. 5 showing the guide and restraint structure which straddles the bar stock and helps keep it in position.

The lower stationary portion 36 of the die assembly is bolted as previously explained to the conventional or stationary bed or bolster of the press (not shown). The lower portion 36 is preferably hollowed out in predetermined locations, namely within center block 112, to define an uncovered open-ended longitudinally extending guide groove, through which stock material can be longitudinally translated between forming steps of the continuously running sequential step process of the present invention. This guide groove 57 is preferably in the range of about 0.008 inch to about .020 inch wider than the bar stock 30 on either side, thus leaving gaps 57*a*. This is best shown in FIG. 6, which shows the bar stock 30 within guide groove 57 and gaps 57*a* on either side of the bar stock. Apart from guiding stock material through the die assembly, the guide groove generally maintains the stock material relatively stable in both longitudinal and transverse directions. The lower die portion 36 also includes a plurality of guide structures 59 and 61 which also help maintain the bar stock 30 in proper longitudinal and transverse position. The two guide structures are substantially identical in cross-section. FIG. 7 shows a cross-section of guide structure 59 taken along line 7—7 of FIG. 5. Once again, small clearances on gaps 63 are provided on either side of the bar stock 30 between side walls of guide 59. The roof plate 65 of guide 59 and like roof of guide 61 also help restrain the bar stock 30 in an upward vertical direction. The presence of the roofs 65 of guides 61 and 59 are desirable to help strip the bar stock off the punch 44 and pilots 52 and 54. It was also determined important to provide enough lateral clearance in guide groove 57 to ensure sufficient room for the lateral displacement of stock material during the coining step. In other words, gaps 57*a* must not be too small, or the bar stock will be bound up in groove 57, and not slide freely in a longitudinal direction.

The lower portion 36 of the die further has a plurality of bores for receiving the downwardly projecting members of the reciprocating upper portion of the die assembly, and for allowing punched-out metal scrap to exit the die assembly. The bores extend downwardly from an upwardly facing surface 58 of the lower portion of the die assembly.

More particularly, near the upstream end 42 of the lower portion there is a first forming bore 60 disposed generally opposite the first forming member 40 on the upper portion of the die assembly. A first pilot bore 62 and a second pilot bore 64 are disposed downstream from the first forming bore 60, and are disposed generally opposite the first and second pilot members of the upper die assembly. Downstream from the first forming bore 60 and first and second pilot bores 62 and 64 there is a second forming bore 66, aligned generally opposite the second piercing member 44.

Also, toward the downstream end 46 of the lower portion 36 of the die assembly 32 there is a cutoff edge 68 defined by the juncture of the upper surface 58 and the vertical surface 70 disposed generally perpendicular with the upper surface 58. Tool steel slab 71 is provided in the lower portion 36 so that this edge 68 can be easily replaced as needed. Cutoff of a formed weld adapter can be thus accomplished by applying downward force to the cutoff member 56, which causes the cutoff member to contact the stock material and cause a shearing of the metal along the edge 68. A weld adapter 10 that has been cut off can then exit the die assembly along a downwardly sloping exit surface 72, as will be explained in greater detail.

Figure 8:
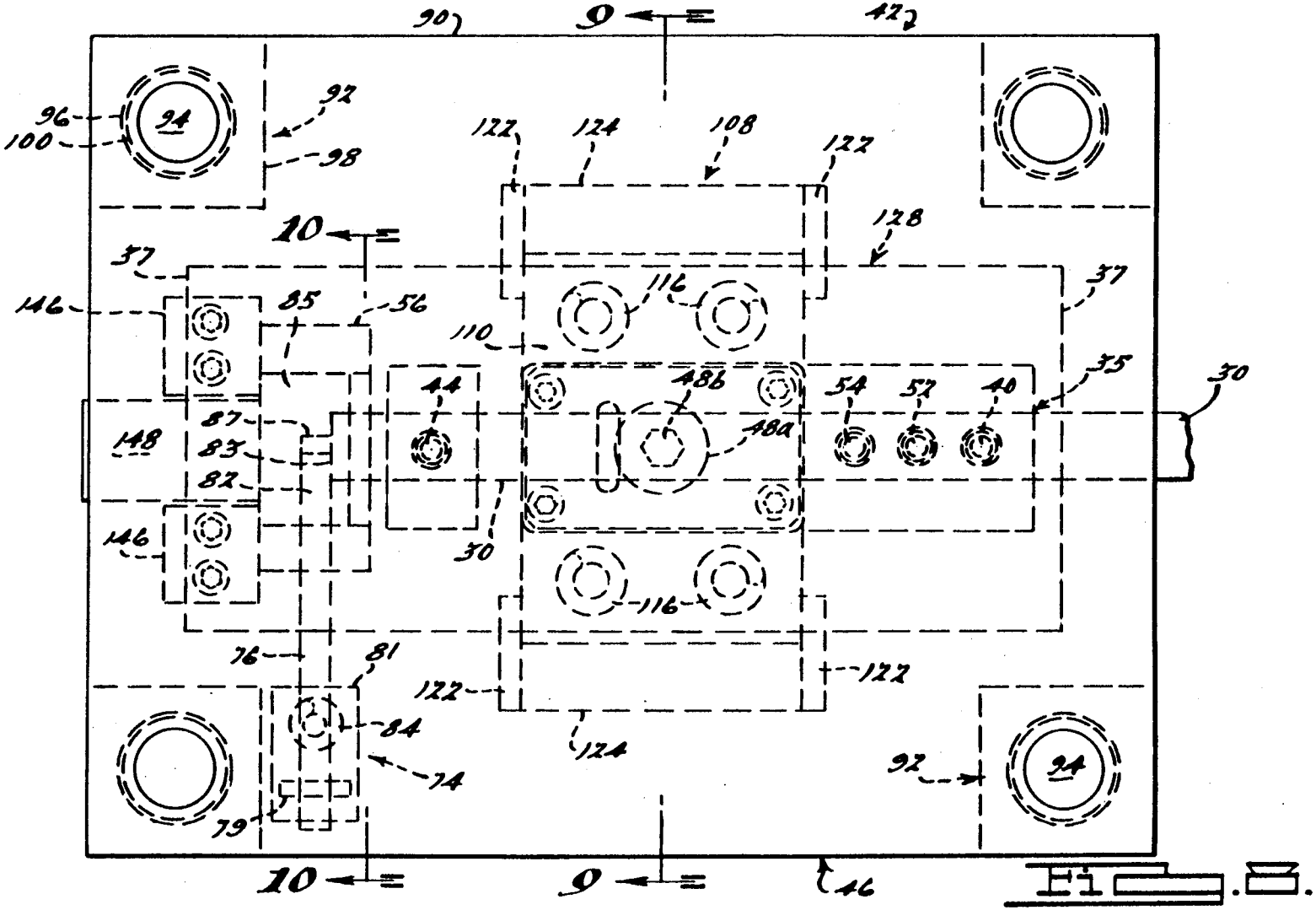
FIG. 8 is an overhead or plan view of the die assembly of FIG. 5.

FIG. 8 shows, in schematic plan view, many of the major parts used in the die assembly 32 just described in respect to FIG. 5, so that the relative positions and construction of these parts may be better understood. The large rectangular block 90 represents the size of upper and lower die shoes, to which are mounted at the four corners thereof conventional guide pin assemblies 92. Each assembly 92 includes a guide pin 94 mounted in a holder 96 attached to a riser block 98 rigidly connected to one of the die shoes. On the opposite die shoe is mounted a bushing 200 attached to another riser block for slidably receiving the guide pin. The four guide pin assemblies thus help ensure proper registration of the upper and lower die sets 34 and 36, in a manner well-known in the art.

Figure 9:
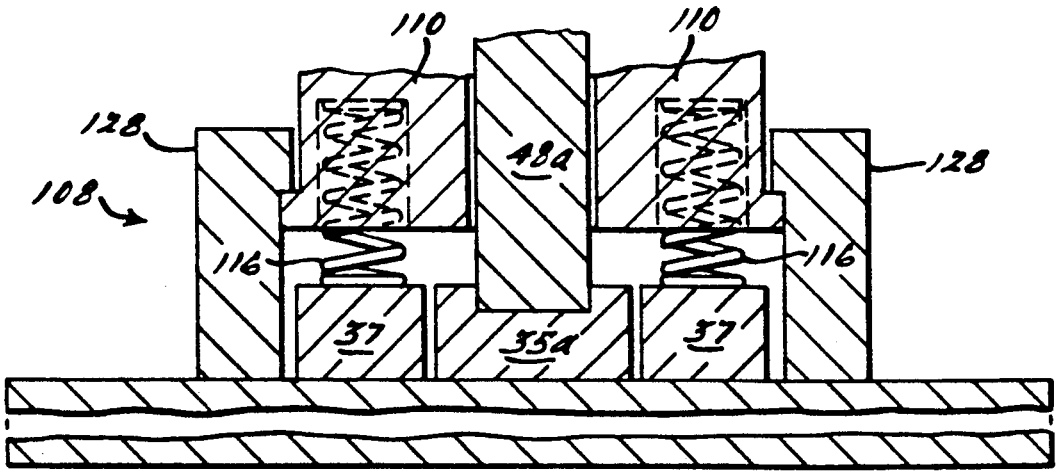
FIG. 9 is a partial cross-sectional view of the central portion of the upper die taken along line 9—9 of FIG. 8 showing the spring-loaded die block, which surrounds the coining tool, in its die-opened or lowered position.

The coining tool 48*a*, which includes a hexagonal end portion 48*b*, is centrally located near the center of the die assembly 32 at the second working station 108. A fragmentary view of station 108 in the open position is shown in FIG. 9. FIG. 5 shows the station 108 and die assembly 32 in its fully-closed position. As can be best seen in FIGS. 5 and 9, station 108 includes a spring-mounted an upper die block 110 surrounding and slidably supporting the tool 48*a*, and a stationary lower die block 112. The upper die block 110 is spring mounted for short-distance travel in a vertical direction relative to its tool steel plate 35*b*. Four conventional die springs 116 are provided as shown in FIGS. 8 and 9 to bias the block 110 downwardly from the support plate 35 in conventional manner. Thus, when the ram of the press begin its downward motion, bottom surface 120 (see FIG. 5) of spring-loaded die block 112 contacts the bar stock 30 first, to bear against and help prevent it from moving in any direction prior to the coining tool 48*a* beginning to displace any metal within the bar stock 30. Having bar stock 30 captured between blocks 110 and 112 also helps minimize an undesirable stock material camber formation that occurs due to the downward deformation forces exerted by the coining tool 48.

As shown in FIGS. 8 and 9, at the second working station 120, side guide blocks 122 and keeper blocks 124 attached to the upper die shoe 90 are provided to retain and guide spring-loaded upper die block 110, so that it moves, more or less, with the press ram in the manner explained in the previous paragraph.

To achieve a continuously-running, sequential step forming of the weld adapters of the present invention, a suitable continuously-running sequential feed device may be employed. In the present embodiment, however, the press is top-stopped between press strokes to allow a conventional pneumatically-powered feeding device (not shown), employed upstream from the die assembly 32, to advance the bar stock 30. The feed device preferably successively advances stock material downstream through a guide groove of the die assembly and stops the stock material in periodic intervals to permit the die assembly to perform an operation on the stock material. In the present preferred embodiment the feed rate is about 600 to about 800 weld adapters per hour, with the knuckle-joint press cycle braking with every stroke in order to stop at the top of the ram's stroke. A suitable feed device for use in the methods of the present invention is a pneumatic bar stock feeder manufactured by Dallas Industries, Inc. of Troy, MI.

It will be appreciated that during forming operations, particularly during coining and shearing steps, metal tends to be displaced in the longitudinal direction as well as in the transverse direction of the stock material. Accordingly, as shown in FIGS. 8 and 10 through 12, a floating gage stop mechanism 74 can be suitably employed with the present die assembly in order to gage and thereby ensure that the metal bar stock 30 is advanced no more than the proper amount between press strokes.

The floating gage stop 74 is preferably located downstream from the cutoff member 56. Preferably the floating gage stop includes an elongated detention member or lever 76 having a pivot pin end 78 and a free or stop end 80. The detention lever 76 is pivotally connected through pivot pin 79 to the lower portion 36 of the die assembly in a region near the first end 78. The detention lever 76 limits the travel of the bar stock material as the bar stock is fed downstream metal forming steps, such as piercing and coining. Yet, the gage stop mechanism 74 permits the metal to be cut off and then exit the die assembly after cut off. In this regard, a spring housing or bore 82 is formed in the block 81 on lower die assembly 36, and contains a spring mechanism 84 therein. The coiled helical spring 84 is preferably disposed between the first and second ends 78 and 80 for upwardly biasing the detention member 76 as shown in FIG. 10.

Figure 10:
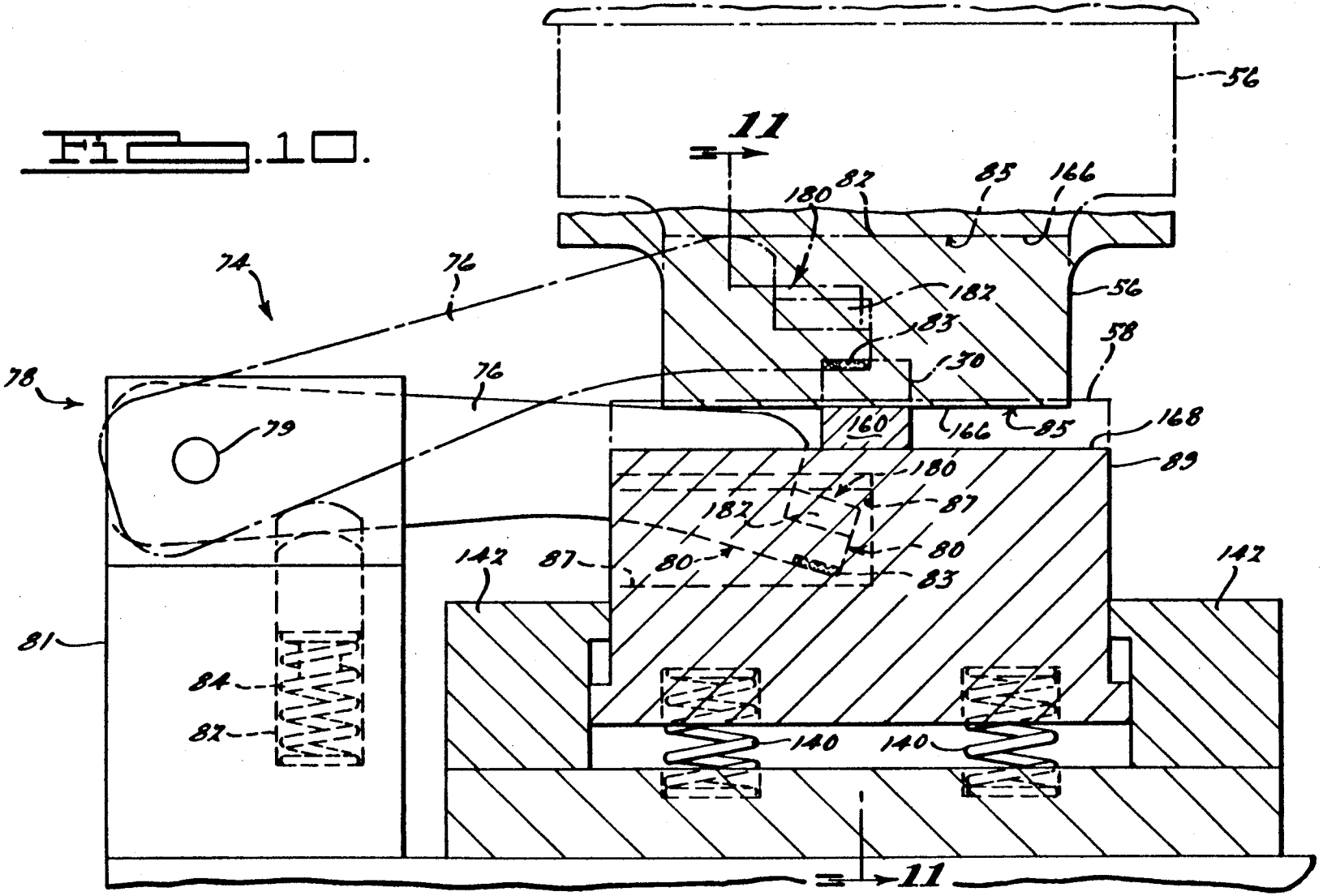
FIG. 10 is an enlarged side view of a floating gage stop of the present invention, taken along line 10—10 of FIG. 8, showing the stop in solid lines in its lowered or fully down position, and in phantom lines in its raised or fully up position.

As best shown in FIG. 10, the detention member 76, in turn, has an upper cam surface 82 for contacting the surface 85 of upper block 56 of the upper die set, and will remain in such contact even as the press ram reciprocates due to the upward bias from the spring mechanism. The detention member 76 is preferably positioned so that a portion 83 (shown cross-hatched) of an upstream facing side thereof will contact the stock material during advancement by the feeder, and prevent any further downstream movement of the stock material. However, as there is downward movement from the upper portion of the die, i.e., before the coining step takes place, the detention lever 76 is pushed down into a pocket 87 in a spring-loaded block 89 in the lower die set 36, so the stock material can be sheared off without having the floating gage stop lever 76 futilely attempting to restrain the slight forward longitudinal expansion of bar stock 30 which takes place during coining.

Figure 11:
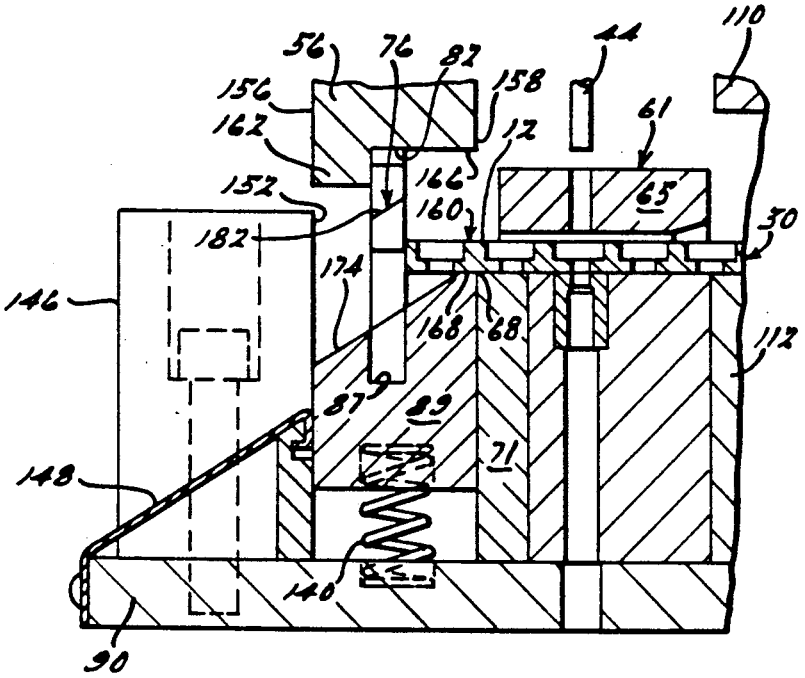
FIG. 11 is a cross-sectional view of the last two working stations of the FIG. 5 die set showing the floating stop in its fully up position.

As shown in FIGS. 10 and 11, block 89 is biased upwardly by two strong die springs 140, and retained transversely by a keeper blocks 142 on either transverse side thereof. As in FIG. 11, block 89 is retained longitudinally by lower shearing plate 71 located upstream and a pair of spaced retention pillars 146 of rectangular cross-section located downstream of, and on either side of, a finished part chute 148 that steeply slopes away downstream. Parts chute 148 may be formed out of sheet metal or any other suitable material. The front sides 152 of retention pillars 146 engage the rear side 15 of upper block 56 prior to the cutting edge 158 of block 56 contacting the upper surface 12 of the weld adapter 160 to be sheared off from bar stock 30. In this manner, the pillars 146 help prevent the upper die block 56 from being forced in a downstream direction by the enormous forces generated by shearing weld adapter 160 from bar stock 30. The downwardly projecting guard lip portion 162 of block 56 is provided to ensure that the sheared off part 160 does not accidentally fly out horizontally in an unrestrained manner.

Figure 12:
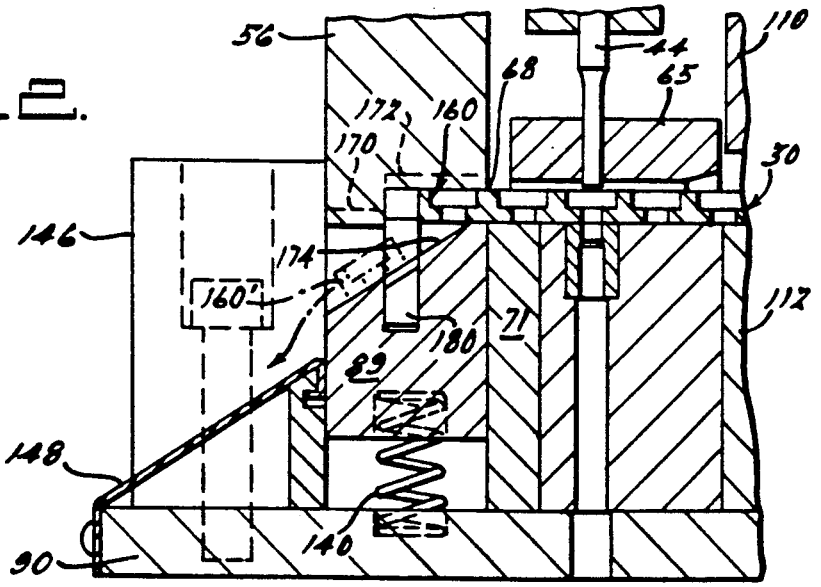
FIG. 12 is a view like in FIG. 10, except that the upper die set and floating gage stop are about half-way back up to their raised position after a weld adapter has been sheared off of the bar stock.

As may be best appreciated by studying FIGS. 10–12, the lower block 89 is strongly spring biased upwardly to optimize the clamping pressure maintained on the part 160 to be sheared off as the upper cutting edge 158 of tool 56 and lower cutting edge 68 of tool 71 begin to shear the part 160 from opposite directions. With the aid of the heavy die springs 140, the part 160 is reasonably securely captured between upper and lower opposed horizontal surfaces 166 and 168 respectively located on blocks 56 and 89. Thus, even as the ram of the press travels downwardly, this clamping pressure is maintained, even after the part 160 has been sheared off.

Next, as shown in FIG. 12, the press ram starts back up, and the upper block 56 and lower block 89 continue to captivate the sheared off part 160. Eventually, however, as indicated by dashed lines 170 and 172, the upper block 56 is raised up far enough to allow the sheared off part 160 to fall downwardly as indicated by phantom part 160' on downwardly sloping surface 174 of block 89. Note that surface 168 of block 89 represents only about one-third of the part 160, so gravity causes the part 160 to promptly topple and slide down surface 174, which is slippery due to residual die lubricant from the sheared off parts and die assembly 32. The cut-off part 160' proceeds to slide down finished parts chute 148 to a finished parts container such as a gon (not shown). The gage stop pocket 87 in the lower block 89 and the length and shape of gage stop lever 76 and its cam surface 82 are all preferably designed to ensure that the exit of part 160' from the die area is not blocked in any way by the lever 76. In particular, as shown best in FIG. 10, the free end 80 of lever 76 has been sculpted to have a reduced size end portion 180 and a surface 182 (best shown in FIGS. 11 and 12) sloping downstream to ensure that cut-off part 160' will not be hindered as it exits the fourth working station of die set 32.

Referring again to FIGS. 3 and 4, a longitudinal section of a bar stock material 30 is shown with various forming operations having been performed thereon. The bar stock 30 and the die set 32 are preferably lubricated as needed with a conventional cutting and die lubricant during the forming operations.

The three different size rectangular weld adapters that are presently being made using the die apparatus and methods of the present invention are as follows (all dimensions are in inches, and the hex head size is measured across the flats):

| LENGTH | WIDTH | THICKNESS | HEX HEAD SIZE | HOLE DIA |
|---|---|---|---|---|
| 1.00 | 1.00 | 7/16 inch | 0.500 | 0.344 |
| 1.25 | 1.25 | 7/16 inch | 0.563 | 0.406 |
| 1.375 | 1.375 | ½ inch | 0.750 | 0.531 |

As is seen, a first hole is formed at the first working station in the stock using any conventional or suitable hole forming methods including, without limitation, punching, and the like. The hole serves as a pilot locator as the bar stock 30 is progressively advanced through the die set, until the metal stock is coined in the region about the hole. At that point material is displaced toward the center of the hole to form a constricted hole 24*a*. In the present preferred embodiment, the coined configuration preferably is a weld adapter for receiving a bolt having a hexagonal head.

As is shown in FIG. 4, a convex region 22*a* preferably surrounds the constricted hole 24*a*. It will be appreciated that, during coining, a significant amount of material is displaced into the region where the first hole was originally defined. The convex region 22*a* corresponds to a portion of that material which is displaced into the concave cavity 50 in the end 48*b* of coining tool 48. Then at the third working station, the convex region 22*a* is removed and the hole is then preferably reopened to its ultimate dimensions by removing substantially all of the dimpled material, such as by punching or piercing. Preferably the dimensions of the original hole are the same or slightly larger than the re-opened hole. The particular size of the re-opened hole is of course dependent upon the size of the shank portion of the fastener, and should be a few thousands to several thousands of an inch larger than the shank size.

The metal stock is cut off at the fourth working station to form individual weld adapters. For a typical generally rectangular-shaped weld adapter, which is preferably square-shaped, the dimensions of the weld adapter are about ¾ inch to about 2 inches on a side. The thickness of the weld adapter is substantially the same as the original stock material thickness, i.e. preferably in the range of about ⅜ inch to about ¾ inch thick, and more preferably about 7/16 inch to about ⅝ inch thick.

Thereafter the weld adapters can be finished using suitable finishing means such as grinding, tumbling, polishing, or the like. Moreover the weld adapters can be surface coated using conventional coating methods to improve their resistance to corrosion and/or oxidation, or to provide a more desirable surface appearnce. It is also contemplated that improved mechanical properties can be obtained if desired by surface treating the weld adapters, such as by conventional heat treatment methods, including carburization or the like.

Although the invention has been described with particular reference to certain preferred embodiments thereof, variations and modifications can be effected within the spirit and scope of the following claims.

What is claimed is:

1. A progressive die apparatus for repetitively making substantially identical weld adapters in a coining press, each such adapter having a hexagonal collar-like configuration and a centrally-located hole for stationarily holding a fastener having a shank portion and a head end by its head end such that the shank portion projects through the hole, the apparatus having at least four working stations where, during successive strokes of the press, metal is formed and removed from an elongated strip of metal stock having a substantially rectangular transverse cross-section and a thickness of at least about ⅜ inch, the die apparatus comprising:

means for restraining the elongated strip of metal stock in two directions substantially normal to the longitudinal direction of movement of the metal stock as the metal stock is advanced downstream;

first punch means, located at the first working station, for repetitively forming first substantially circular thru-holes having a predetermined diameter in successive segments of the metal stock advanced through the first working station;

pilot means, downstream from the first working station, for helping stabilize the metal stock when metal-forming pressure from the press is applied to said stock, said pilot means including at least one pilot tool which enters at least one of said first holes in the metal stock;

coining means, located at a second working station downstream from the pilot means, for repetitively cold-forming said metal stock in regions surrounding successive ones of the first holes to make in each segment of stock passing therethrough a collar-like configuration having a hollow hexagonal region for receiving a head end of a fastener, the coining means being arranged to reduce the diameter of the first holes without restricting the inward flow of metal stock into such holes during the diameter reduction;

second punch means, located at a third working station downstream from the second working station, for repetitively reforming the first holes in successive segments of the metal stock advanced through the third working station;

means, located at a fourth working station, for successively shearing segments of the metal stock including reformed first holes from the upstream portion of the metal stock; and means, located near the fourth working station, for limiting longitudinal advancement of the metal stock between strokes of the press.

2. The die apparatus of claim 1, wherein the coining means includes a plunger tool having an end portion provided with a hexagonal cross-section, the end portion including an end face provided with a centrally located concave cavity of sufficient volume to permit flow therein of some of the metal stock flowing during coining to reduce the force required to accomplish the coining operation.

3. A method of cold forming a weld adapter having a collar-like hexagonal configuration and a centrally-located hole for stationarily holding a fastener having a generally circular shank portion and a larger hexagonal head end by its head end such that the shank portion projects through the hole, comprising the steps of:

(a) forming a hole having a first diameter in an elongated metal bar stock material;

(b) coining said stock material in an area surrounding the hole in a manner which defines a collar-like configuration of hexagonal cross-section for receiving a bolt having a hexagonal head while simultaneously reducing the diameter of the hole without restricting the inward flow of metal stock into such hole during such diameter reduction;

(c) removing stock material that was displaced into the hole region during coining; and (d) cutting said stock material to sever one formed weld adapter from the remaining stock material.

4. The method of claim 3 wherein said hole-forming step (a) includes piercing a hole in said stock material.

5. The method of claim 3 wherein said forming step (a), coining step (b) and removing step (c) are performed sequentially.

6. The method of claim 3 further comprising the step of:

(e) advancing said stock material from a location for said forming step (a) to a location for said coining step (b) to a location for said removing step (c).

7. A method of cold forming a weld adapter for stationarily holding a bolt having hexagonal head and shank portion of smaller cross-sectional area than that of the head respectively in first and second hole regions in the weld adapter of hexagonal cross-section and circular cross-section, the method comprising the steps of:

(a) piercing a first circular hole, having a diameter in the range of about 0.25 inch to about 0.75 inch, in elongated steel bar stock material having a thickness of about $\frac{3}{8}$ inch to about $\frac{3}{4}$ inch;

(b) coining said stock material in an area surrounding said first hole to define a collar-like configuration of hexagonal cross-section which constitutes the first hole region of a weld adapter and which receives a bolt having a hexagonal head, the coining step being carried out in a manner which reduces the diameter of the first hole without restricting the inward flow of metal stock into such hole during such diameter reduction;

(c) re-piercing said stock material to remove stock material that was displaced into said area surrounding said hole during said coining step (b);

(d) successively advancing said stock material from a location for said hole-forming step (a) to a location for said cold-forming step (b), and a location for said re-piercing step (c); and (e) cutting said stock material after steps (a), (b) and (c) to define a weld adapter for welding to a surface so that a stem of said bolt projects away from said surface; and wherein said piercing steps (a) and (c), said coining step (b), and said cutting step (e) are accomplished using a progressive die apparatus in a mechanical power press having a reciprocating ram.

8. The method according to claim 7 wherein said cutting step (e) includes cutting said stock material into generally rectangular blocks having dimensions in the range of about 0.75 inches to about 2.0 inches.

9. The method according to claim 7 wherein said steel stock material is a steel having a carbon content of about 0.08% by weight to about 0.20% by weight of its total composition.

10. The method of claim 7 further comprising helping prevent downstream movement of stock material during metal forming by employment of a floating gage stop.

* * * * *